US005895083A

United States Patent [19]

Bidwell

[11] Patent Number: 5,895,083

[45] **Date of Patent: *Apr. 20, 1999**

[54] AUTOMATIC CABLE DISCONNECTOR

[75] Inventor: James D. Bidwell, 2880 S. Locust Apt. 201-N, Denver, Colo. 80222

[73] Assignee: James D. Bidwell, Lakewood, Colo.

[ * ] Notice: This patent issued on a continued prosecution application filed under 37 CFR 1.53(d), and is subject to the twenty year patent term provisions of 35 U.S.C. 154(a)(2).

[21] Appl. No.: 08/713,835

[22] Filed: Sep. 13, 1996

Related U.S. Application Data

[60] Provisional application No. 60/003,748, Sep. 14, 1995.

[51] Int. Cl.[6] ..... B66C 1/38

[52] U.S. Cl. ..... 294/75; 294/82.31

[58] Field of Search ..... 294/75, 82.19, 294/82.2, 82.24–82.27, 82.31, 82.33–82.36; 24/599.1, 599.3, 599.9, 600.3

[56] References Cited

U.S. PATENT DOCUMENTS

| | | | |
|---|---|---|---|
| 2,519,914 | 8/1950 | MacCluney | 294/82.33 |
| 2,864,644 | 12/1958 | Marryatt | 294/82.31 X |
| 3,239,266 | 3/1966 | Elliott | 294/75 X |
| 3,428,355 | 2/1969 | Hamilton | 294/82.31 |
| 3,493,260 | 2/1970 | Smith | 294/82.33 |

FOREIGN PATENT DOCUMENTS

| | | | |
|---|---|---|---|
| 317604 | 10/1971 | Russian Federation | 294/82.31 |
| 637314 | 12/1978 | Russian Federation | 294/82.31 |
| 1022932 | 6/1983 | Russian Federation | 294/82.19 |

*Primary Examiner*—Johnny D. Cherry
*Attorney, Agent, or Firm*—Emrich & Dithmar

[57] ABSTRACT

A cable disconnector assembly is described for use with a lifting hook of a lifting assembly for disconnecting the lifting cable from the lifted material. The disconnector assembly includes a vertical suspended member having an upper end eyelet portion engageable with the lifting hook of the lifting assembly, a lower end portion having a slotted opening therein, and a recessed shoulder portion. A jaw member is hingedly mounted to the lower end portion through the slotted opening and operable between an open disengaging position and a closed engaging position wherein the jaw member rests in the recessed shoulder portion. The lower end portion of the vertical suspended member includes extension members which engage the surface of the lifted material to move the jaw member from a closed position to an open position to permit disconnection of the lifting cable from the lifted material. A locking mechanism is provided to prevent movement of the jaw member from the closed position to an open position.

8 Claims, 8 Drawing Sheets

AUTOMATIC CABLE DISCONNECTOR

The present application claims the benefit of United States provisional application 60/003,748, filed Sep. 14, 1995.

BACKGROUND OF THE INVENTION

The present invention relates to a lifting device which automatically disconnects the lifting cable from the bundle of lifted material when the lifting device engages the bundle of lifted material that has been placed in an at rest position and claims the benefit of United States provisional application 60/003,748, filed Sep. 14, 1995.

In the past, there has been a need for a simple and efficient means of lifting bar joist, wooden roof joists, trusses or other bar or tubular material to position these materials at a work site for proper installation. In accordance with the prior art, the preferred method and apparatus for lifting and for positioning hanging bar, joist, roof joists and other bar or tubular material at a work site for installation has been the utilization of a crane lifting cable secured to a headache ball having a lift hook member secured to the ball. The lift hook member generally includes a spring biased closure member which prevents dislodgement from the lift hook member of an open hook member which is used to engage the shackled ends of a lifting cable that is engaged with the truss or bar stock to lift and move the truss or bar stock to the desired installation position. However, safety regulations have precluded the use of open hook members to engage shackled ends of a lifting cable because of the danger of injury due to accidental disengagement of the shackled end of the lifting cable from the open hook member.

To overcome such unsafe prior art devices, it has been suggested to utilize spreader cables with choker members which are specially wrapped around the bar stock or truss material for lifting the same. The spreader cable has an eyelet or ring which is engaged with the lifting hook member having a spring bias closure which prevents accidental removal of the spreader cable from the lift hook member. However, such devices although being safe for use, are slow and inefficient and require the workers to walk out onto the bar, joist or truss material to unhook the cable, a time consuming operation and, sometimes, a dangerous operation.

Finally, it has been suggested to utilize an automatic hook disengaging device which includes an attachment portion which engages the lifting hook or is directly shackled to the crane lifting cable. The disengaging device is comprised of a first portion which engages the cables or lifting hook and a center portion which is pivotally mounted to the first portion and includes a hook member pivotally mounted to the lower end thereof. In operation, such automatic hook release structures require the engagement of a lifting cable with the hook member and wherein the subsequent lifting of the bar or truss material pivotally moves the center portion to a vertical substantially parallel configuration to close the jaw of the hook member. When the raised load is lowered into position, contact of the hook device with the lifted object results in the hook member being positioned perpendicular to the vertical, with the center portion positioned at an angle to the upper first portion. However, such devices must engage precisely the top portion of the bar or truss material to cause the hook member to be positioned perpendicular to the vertical to release the hook member from the lifting cable, a condition which is difficult to achieve. Moreover, oftentimes when such automatic hook devices are in the open position, a worker still has to climb onto the lifted bar, joist or truss material to remove the lifting cable from the hook. Finally, such devices are expensive and, accordingly, have only found limited acceptance in the marketplace.

SUMMARY OF THE INVENTION

The present invention relates to a cable disconnector device which automatically disconnects the lifting cable from the bundle of joists or trusses when the lifting device engages the bundle when the bundle of material has been placed at the desired at rest position. The cable disconnector device is comprised of a vertical suspended member or portion that is attachable to the lift hook member secured to the headache ball of a conventional crane operated lifting assembly. The vertical suspended portion includes an upper eyelet or opening portion which is engagable with the lifting hook member such that when the cable disconnector device is engaged with the lifting hook member, the spring biased closure of the lifting hook member, prevents dislodgement of the disconnector from the lift hook member. Additionally, the cable connector device includes a hinged jaw member which is pivotally connected to the lower portion of the vertical suspended portion. Preferably, the lower portion of the vertical suspended portion is necked down and includes a slotted opening therein which is structurally arranged to receive a pin member that is attached to the hinged jaw member. The lower portion of the hinged jaw member presents a yoke type structure having openings therein which receive the pin inserted through the slotted opening of the lower portion of the vertical suspended portion to provide pivotal hinged movement of the jaw member to permit the jaw member to move from a closed position to a fully open position, as will hereinafter be described.

Additionally, the vertical suspended member or portion includes a projection portion thereon which defines a recess or saddle portion which cooperates with the upper end of the jaw member to receive therein a pin member that extends through the upper end of the pivotally hinged jaw member. The upper portion of the jaw member has, preferably, a yoke member configuration with openings therein which receive the locking pin member. When the jaw member is pivoted against the upper portion of the vertical suspended portion and a downward force is applied, the locking pin member is engaged with the recess or saddle portion and the disconnector assembly is closed and in the locked lifting position. The slotted opening at the lower portion of the vertical suspended portion of the cable disconnector device permits the slidable movement upwardly and downwardly of the pivotally hinged jaw member to permit engagement of the locking pin member with the recess or saddle portion. When a lifting force is applied to the disconnector device, the pivotally hinged jaw member remains pulled downwardly such that the locking pin in the upper end thereof is maintained in the saddle or recess portion of the vertical suspended member to lock the pivotally hinged jaw member thereto. This pulling force occurs, during lifting of bundles of bar, joist, trusses and the like, and when the eyelet or end of the lifting cable is inserted over the pivotal hinged jaw member and retained within the cable connector device in the closed locked position.

The lower portion of the pivotally hinged jaw member includes winged extensions or projection means thereon which extend outwardly from or below the suspended cable disconnector device. When the bundled load of bar joists or truss materials has been lifted and moved to the desired at rest position, the continuing lowering of the cable disconnector device results in the projection means on the pivotally hinged jaw member engaging the upper surface of the positioned bar joists or truss material. Such engagement causes the pivotally hinged jaw member to be raised upwardly within the slotted opening to be moved from the locked lifting position to the unlocked disengaging position. Simultaneously, the upper pin member of the pivotally hinged jaw member is released from the saddle or recess in the vertical suspended portion. When the jaw member is in such a position, the pivotal jaw member opens and automatically releases the end or eyelet of the lifting cable from the cable disconnector device.

The pivotally hinged jaw member is preferably comprised of two arcuate shaped facing plates which include a spacer member therebetween to provide the upper and lower ends of the jaw member with a yoke-type structure. The yoke-type structure readily permits the engagement and the pivotal mounting of the hinged jaw member to the lower end of the vertical suspending member and permits the locking and unlocking of the jaw member portion with respect to the vertical suspended portion by engagement and disengagement of the upper locking pin to and from the recess.

The cable disconnector device may further include a detent assembly or means which is operatively associated with the slotted opening in the lower portion of the vertical suspended member. The detent assembly facilitates retaining the lower pivotal pin of the jaw member within the slotted opening in the lower locked position and in the upper open released position.

A further embodiment of the present invention includes an L-shaped locking member which is pivotally mounted to the vertical suspended member intermediately between the saddle portion and the lower end portion. The L-shaped locking member includes a hook portion on an upper extension member and a spring or bias means or member anchored to the vertical suspended member and engageable with a lower extension member to bias the hook portion in an outwardly position wherein it cooperates and is structurally arranged to engage a recess in the upper end of the spacer member. In such a position, the locking member retains the attached jaw member and associated locking pin in engagement with the recess or saddle portion in the fully locked position. A cable member is anchored to the hook portion of the upper extension member and extends through a pulley member mounted on the vertical suspended portion above the locking member to facilitate disengagement of the locking member from the pivotally hinged jaw member to thereby permit the jaw member to move from the locked to the unlocked position when the extensions engage the surface of resting lifted material.

When the winged extension or extensions extending below the pivotally hinged jaw member engage the upper surface of the positioned bar, joists, or truss material, the hook portion of the locking member engaged with the recess in the upper portion of the spacer member retains the attached jaw member and associated locking pin in locked engagement with the recess or saddle portion of the vertical suspended portion. This locked engagement provides a locked condition for the cable disconnector device and prevents automatic disengagement of the jaw member from the vertical suspended portion when the winged extensions engage the upper surface of the positioned bar, joist or truss material.

Thus, when it is desired to disengage the cable disconnector device from the associated lifting cable or cables, the cable member is pulled through the upper mounted pulley member to pivotally move and to disengage the hooked portion of the L-shaped locking member from the recess in the upper end of the spacer member. This pivotal movement of the L-shaped locking member permits the pivotally hinged jaw member to be raised upwardly to be disengaged from the slotted opening and to move from the closed engaging position to the open disengaging position. Simultaneously, the upper pin member of the pivotally hinged jaw member is released from the saddle or recess and the jaw member automatically opens and moves to the open position thereby automatically releasing the eye or eyelet of the lifting cable from the cable disconnector device.

Other and further significant objects of the present invention will be apparent from the following description which is illustrated in the accompanying drawings which, by way of illustration, show a preferred embodiment of the present invention and the principles thereof and what I now consider to be the best mode in which I have contemplated applying these principles. Other embodiments of the present invention providing the same or identical equivalent principles may be used and structural changes which may be made as desired by those skilled in the art without departing from the scope of the present invention.

DESCRIPTION OF THE DRAWINGS

For facilitating and understanding the present invention, there is illustrated in the accompany drawings a preferred embodiment thereof, from an inspection of which, when considered in connection with the following description, the invention, its construction and operation and many of its advantages will be readily understood and appreciated.

FIGS. 8A–8F illustrate the use and application of the cable disconnector device in accordance with the present invention for the lifting and movement of bar, joist, truss material and the like;

DETAILED DESCRIPTION

Figure 1:
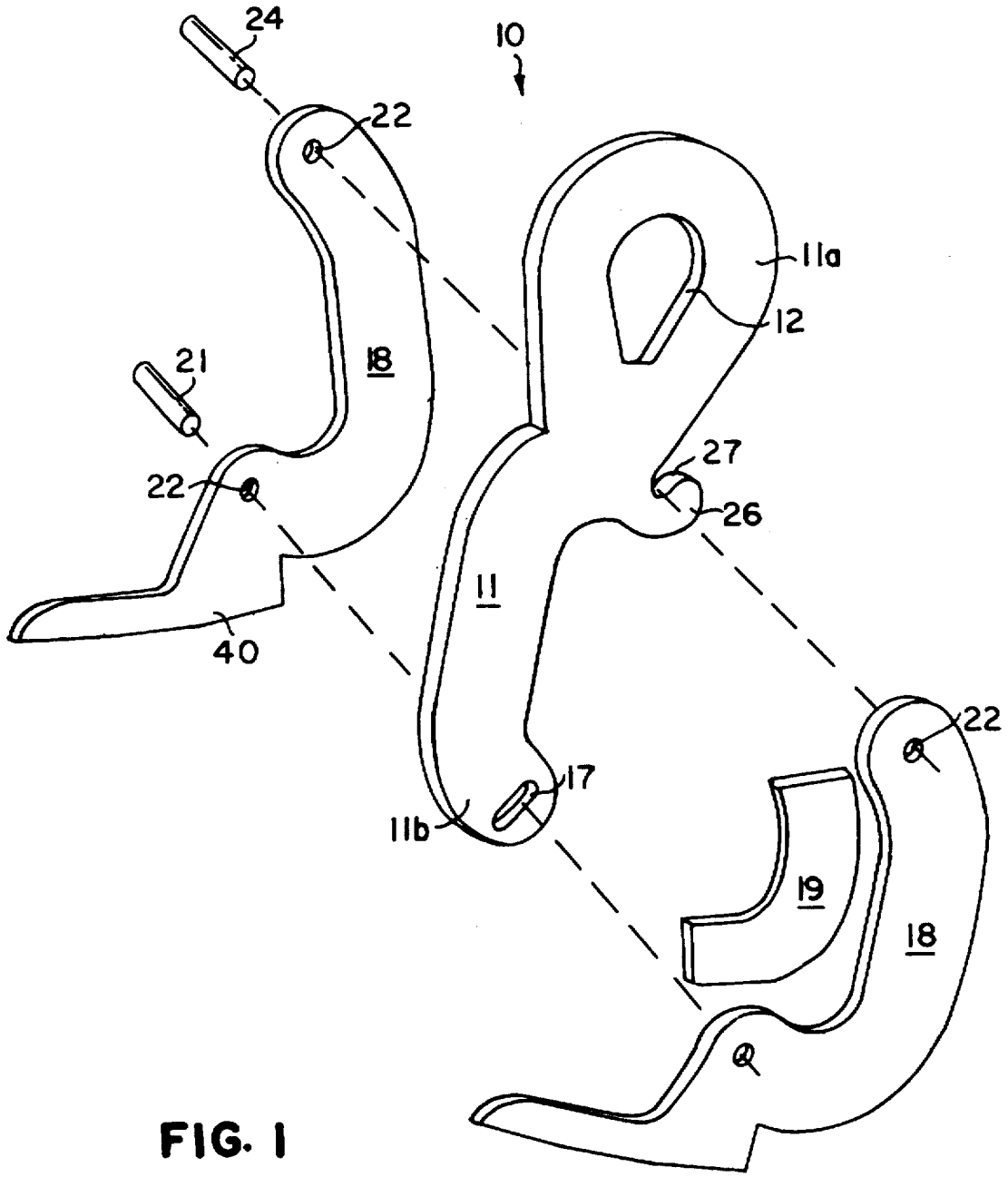
FIG. 1 is a perspective view of the structural elements illustrating the assembly of the cable disconnector device in accordance with one embodiment of the present invention.
Figure 4:
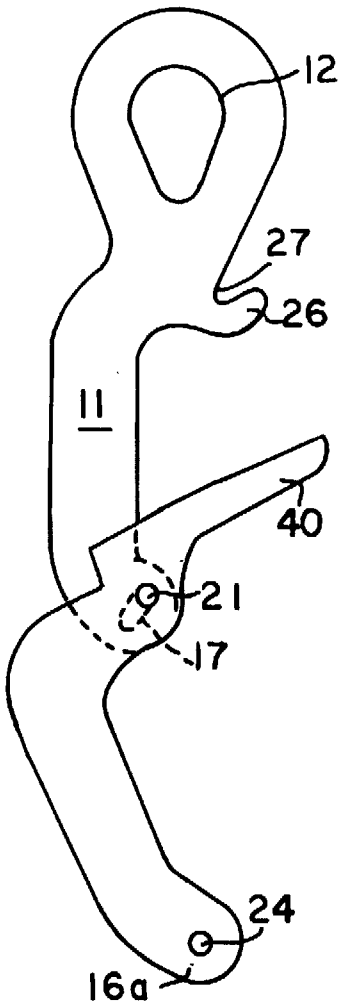
FIG. 4 is a side view of the cable disconnector device of FIG. 1 illustrating the pivotal movement of the jaw member from the closed to the open position which frees the eye of the lifting cable from the cable disconnector device.

The present invention is illustrated in the accompanying drawings, wherein like numerals have been used throughout the several views to designate the same or similar parts, relates to a lifting device or assembly 10 which automatically disconnects a lifting cable from the bundle of lifted material upon engagement of the lifting device with the bundle of lifted material or selectively disconnects a lifting cable from the bundle of lifted material upon engagement of the lifting device with the bundle by the triggering of a locking mechanism 50. As shown in FIG. 1, the cable disconnector device or assembly 10 is comprised of a vertical suspended base member or portion 11 having an eyelet 12 therein, which eyelet is adapted and structurally arranged to be attached to a lift hook member 14 (FIGS. 8A–8F) secured to the headache ball 15 (FIGS. 8A–8F) of a conventional crane operated lift assembly, as is known in the art. The vertical suspended base portion 11 includes an eyelet or opening 12 at the upper end 11*a* thereof which is adapted to be structurally arranged to engage and be held by a lifting hook member 14 when the cable disconnector device 10 is mounted on the lifting hook member. As shown in the drawings, the vertical suspended member or portion 11 may be of a one piece construction, as shown in FIGS. 1–4 and 8–12, or it may be comprised of a plate material 13 having an eyelet 14 therein which is secured by bolts, welding, or the like 13*a* to the vertical suspended base member 11, as shown in FIG. 13. In accordance with the present invention, the lower end portion 11*b* of the vertical suspended base member 11 may be necked down and may include a slotted opening 17 therein which is structurally arranged to receive a lower pin member 21 that is attached to the hinged jaw member 16, as shown in FIGS. 1–3, 5, and 9–14. The jaw member 16 (FIGS. 2–4, and 10–13) is, preferably, comprised of a pair of facing plates 18 which are a mirror image of one another, with the facing plates having spacer member 19 therebetween. As shown in FIGS. 1, 6, 7, and 9–14, the spacer member 19 is of a length less than the overall length of the facing plates 18 such that the upper end 16*a* and lower end 16*b* of the hinged jaw member 16 are structured to provide a yoke-type structure having openings 22 in each of the facing plate ends 18*a* and 18*b*.

The openings 22 are adapted to receive pin members 21 and 24, as will hereinafter be described. The openings 22 of the lower end 16*b* of the hinged jaw member 16 are adapted to be axially aligned to receive a lower pin member 21 therebetween which has been additionally threaded through the slotted opening 17 on the lower end portion 11*b* of the vertical suspended base member 11. The lower pin member 21 acts as a pivot point with respect to permitting the hinged jaw member 16 to pivot with respect to the slotted opening 17 in the lower end 11*b* of the vertical suspended base member 11 of the disconnector device 10. The openings 22 in the upper end 16*a* of the hinged jaw member 16 are adapted to receive an upper pin member 24 to complete the assembly of the cable disconnector device 10.

Figure 2:
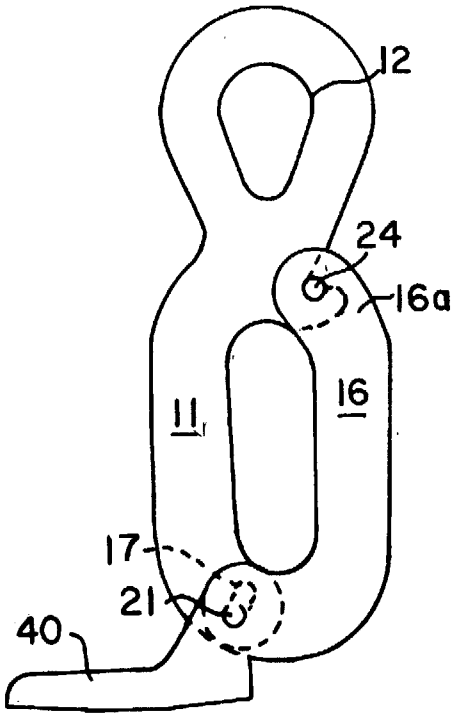
FIG. 2 is a side view of the cable disconnector device of FIG. 1 when positioned in the loaded locked position.
Figure 8A:
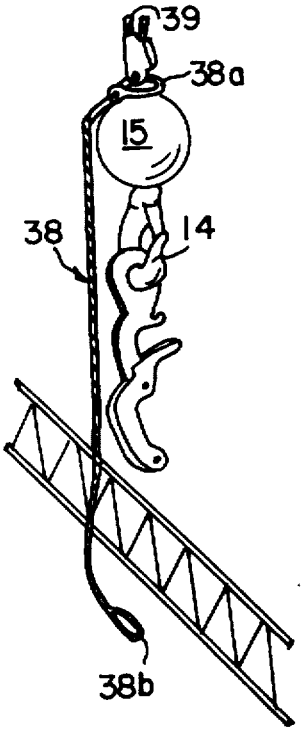
Figure 8B:
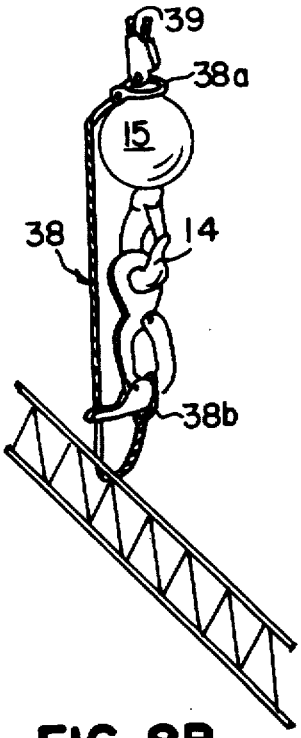
Figure 10:
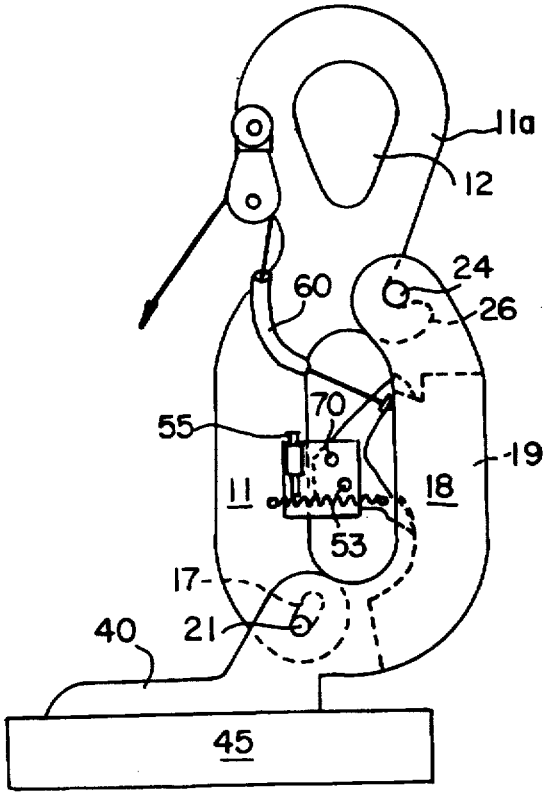
FIG. 10 is side view of the cable disconnector device of FIG. 9 when positioned in the loaded locked position and engaging surface of the positioned truss.

The vertical suspended base member 11 includes a shoulder or projection portion 26 thereon which provides a recess or a saddle means or portion 27 that cooperates with the upper pin member 24 mounted to the upper plate ends 16*a* of the jaw member 16. The saddle means is structurally arranged to receive the upper pin member 24 of the hinged jaw member 16 when the cable disconnector device 10 is engaged in lifting the lifted material, the lower closed engaging position, as shown in FIGS. 2, 8B, and 10.

Figure 3:
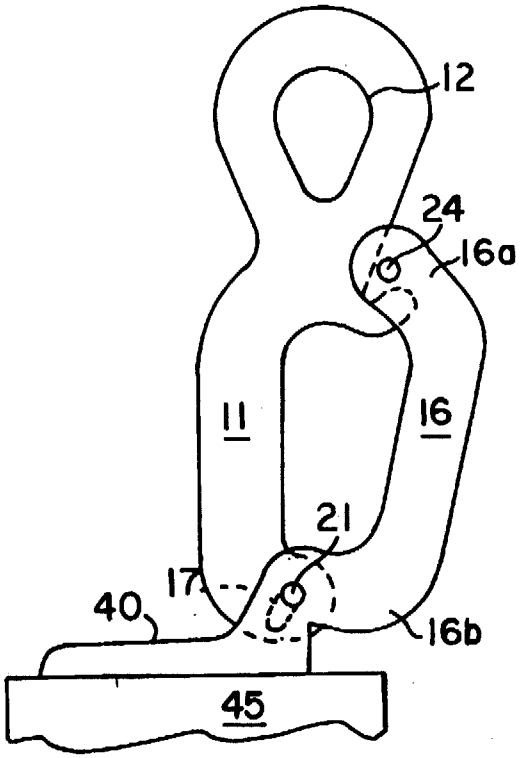
FIG. 3 is a side view of the cable disconnector device of FIG. 1 showing the engagement of the cable disconnector device with the surface of the positioned truss.
Figure 5:
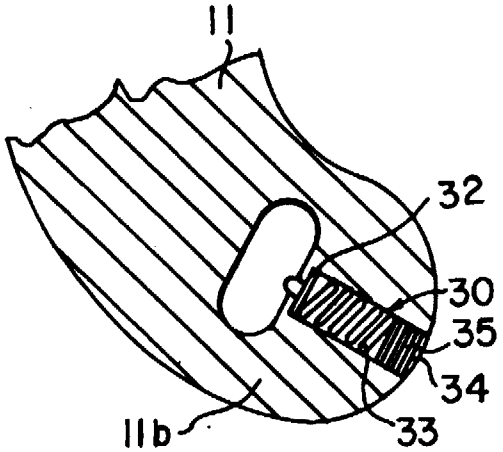
FIG. 5 is an enlarged view of the spring biased detent means or member which facilitates retention of the cable disconnector device in either the locked or unlocked position in accordance with the present invention.
Figure 8C:
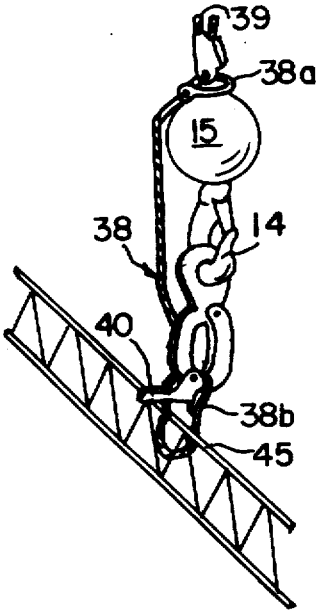
Figure 8D:
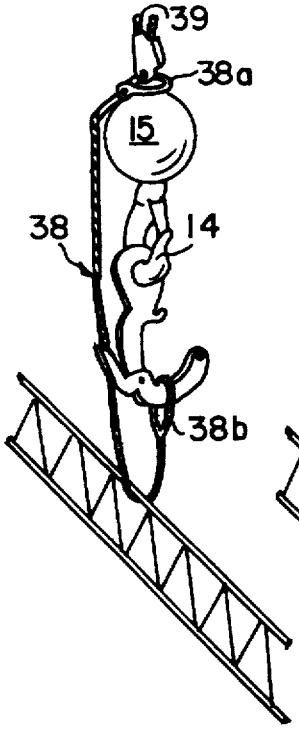
Figure 8E:
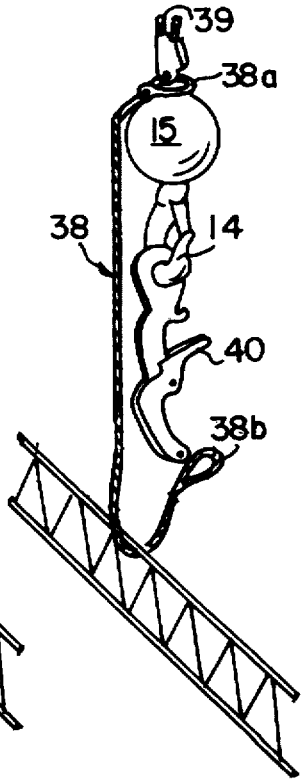
Figure 8F:
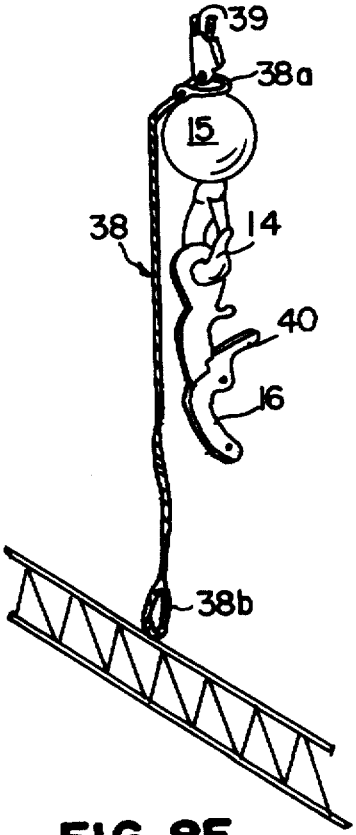

As shown in FIG. 5, the lower end 11*b* of the vertical suspended base member 11 includes a detent assembly or means 30 which structurally cooperates with the slotted opening 17 and which provides a safety feature for the present invention. The detent assembly 30 includes a spring biased ball plunger 32 that partially extends through threaded opening 35 in the lower end 11*b* which cooperates with the slotted opening 17 intermediate the ends thereof. The detent assembly 30 is comprised of a spring biased ball plunger 32 that is biased by spring 33 that is held in position by a threaded opening set screw 34 in the threaded opening 35. In operation, the detent assembly or means 30 and the associated spring biased ball plunger 32 hold the lower pin member 21 in the bottom of the slotted opening 17 until the full weight of the lifting device firmly retains the hinged jaw member 16 to the bottom of the slotted hole and the upper pin member 24 in the saddle means 27, the position as shown in FIGS. 2, 8B, and 10. In such a position, the cable disconnector device 10 is in the closed engaging position ready for the hoisting operation of the lifted material, as shown in FIGS. 2, 8B, and 10. In FIGS. 8A through 8F, the upper end 38*a* of the lifting cable or nylon strap 38 is secured to the crane lifting cable 39 at the junction between the headache ball 15 and the crane lifting cable 39. However, it is within the scope of the present invention that the upper end 38*a* of the lifting cable 38 may be anchored to the lifting hook member 14. In such an instance, the crane may be used for lifting tanks or any other article where the cable or nylon strap 38 may be slung around the article to lift the same. The other looped end 38*b*, as shown in FIG. 8A, is made ready for threading through the joist or truss material such that the looped end 38*b* is looped through the hinged jaw member 16 and the clamped enclosed disconnector device 10, the locked lifting position as shown in FIG. 8B. In such a position, the upward movement of the crane lifting cable headache ball 15 lifts the bar, joist, truss material or bundles to the desired working location and then the lifted materials are brought to an at rest position at the work site. Further downward movement of the crane lifting cable and the headache ball 15, causes the projections, or feet extensions 40 extending from the lower end 16*b* of the hinged jaw member 16 to engage the surface 45 of the bundle of resting material, which results in the upward movement of the hinged jaw member 16 from the lower closed engaging position to the upper unlocked position, as shown in FIGS. 3 and 8C. Simultaneously, with the engagement of the feet extensions 40 with the surface 45, the movement of the hinged jaw member 16 from the lower locked position to the upper unlocked position occurs wherein the lower pin member 21 is positioned in the upper end of the slotted opening 17 and the pin member 24 is positioned free of saddle 26, as shown in FIG. 3. In such a position, the hinged jaw member 16 then opens to release the eye or eyelet of the lifting cable 38 from the lifting device, as shown in FIGS. 4, 8D, 8E and 8F. Because the lifting disconnector device 10 is in the fully open position, the lifting cable 38 is hanging free of the bar, joist or truss material, as shown in FIG. 8F. In this position, the lifting cable 38 may be hoisted free of the joist or truss material to prepare the disconnector device 10 for another lifting operation.

Additionally, it is within the scope of the present invention that the lower end portion 11*b* of the vertical base member 11 may include a pin member 21 or projection mounted therein and extending outwardly from each side thereof. This pin member cooperates with aligned slotted openings in the lower end 16*b* of jaw member 16 to permit and provide the sliding up and down movement of the jaw member and to provide a pivot point for the pivotal movement of the jaw member during operation of the assembly 10, as has been disclosed.

A further embodiment of the present invention is shown in FIGS. 9–13 and includes an L-shaped locking means or member 50 which is pivotally mounted by pin member 70 to aligned openings 72 in bracket member 51 extending from the vertical suspended base member 11 intermediately between the saddle portion 27 and the lower portion 11*b*. The L-shaped locking member 50 includes a hook portion or member 52 associated with and structurally arranged on an upper extension member 54 and a spring member 56 anchored to the suspended member 11 and engagable with a lower extension member 58 to bias the hook portion in an outwardly locking position wherein it cooperates and is structurally arranged to engage a recess 60 in the upper end 19*a* of the spacer member 19 to prevent accidental openings of the assembly 10. The locking member retains the attached jaw member 16 and associated locking pin 24 in engagement with the recess or saddle portion 27. A cable member 62 is anchored to the upper extension member 54 and extends through a pulley member 64 mounted on the vertical suspended portion above the locking member 50 to facilitate disengagement of the pivotally hinged jaw member 16 from a locked to an unlocked position, as will hereinafter be described.

When the projections or feet extensions extending below the pivotally hinged jaw member engage the upper surface 45 of the positioned bar, joist, or truss material, the hook portion 52 of the locking member 50 engaging the recess 60 in the upper portion of the spacer member 19 firmly retains the attached jaw member 16 and associated locking pin in locked engagement with the recess or saddle portion of the vertical suspended portion. This structure insures that the cable disconnector device is retained in the locked position and prevents disengagement of the jaw member from the vertical suspended portion when the feet extensions engage an upper surface of the positioned bar, joist, or truss material or another obstacle during operation.

Thus, when it is desired to disengage the cable disconnector device 10 from the lifted load, after the feet extensions 40 engage the surface 45 of the lifted material, the cable member 62 is pulled through a tubular member 66 aligned with the upper mounted pulley member 64 to apply a force to the upper extension member to pivot and to disengage the hooked portion 52 on the upper extension member 54 of the L-shaped locking member 50 from the recess 60 in the upper end of the spacer member 16. This pivotal movement of the L-shaped locking member 50 permits the pivotally hinged jaw member 16 to be raised upwardly within the slotted opening 17 and moved from a locked to an unlocked position because of the engagement of the extensions 40 with the surface 45. Simultaneously, the upper pin member 24 of the pivotally hinged jaw member is released from the saddle or recess and the jaw member automatically opens and moves to the open position thereby automatically releasing the eye or eyelet of the lifting cable from the cable disconnector device 10.

Figure 9:
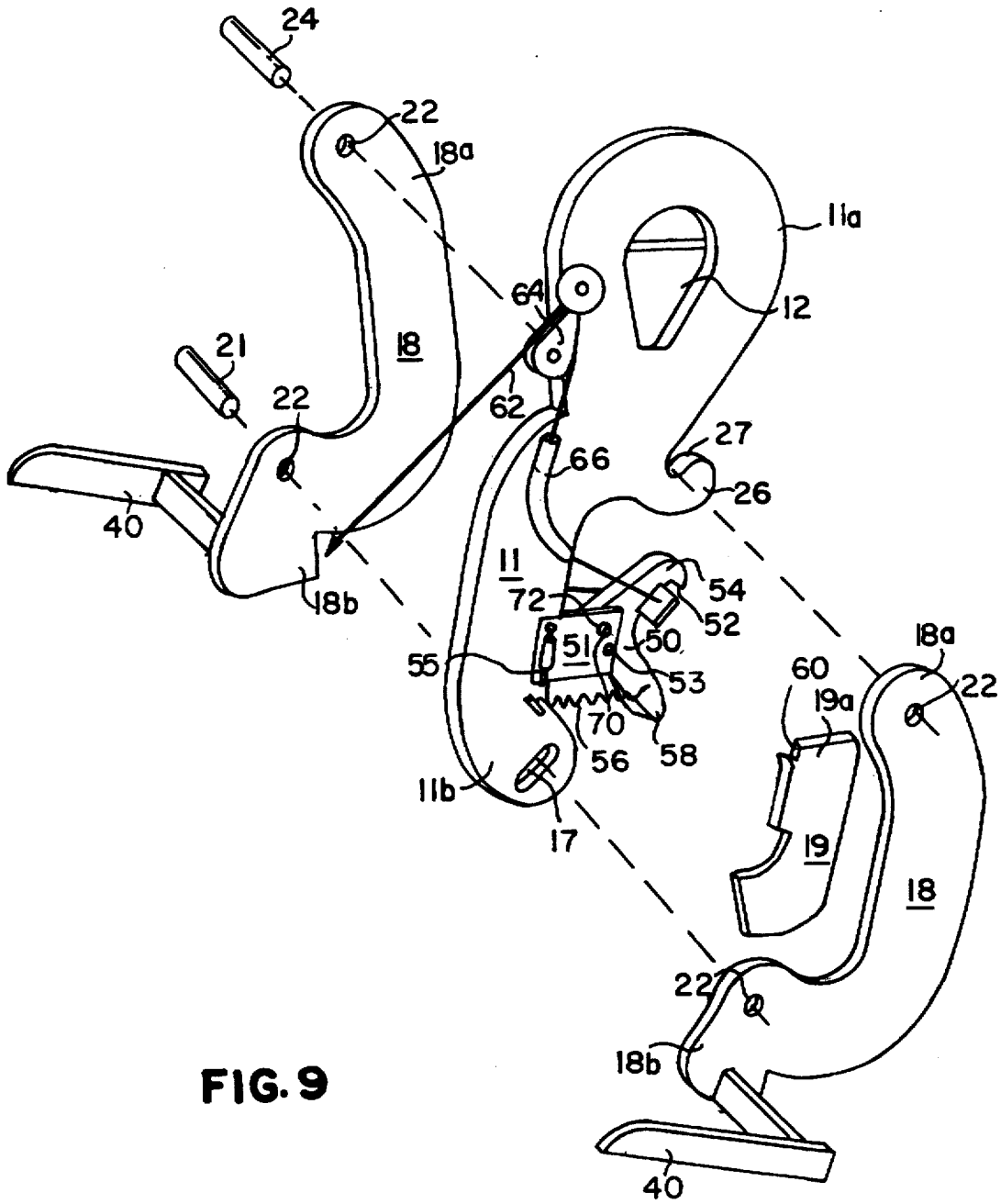
FIG. 9 is a perspective view of the structural elements illustrating the assembly of the cable disconnector device incorporating a locking member in accordance with a further embodiment of the present invention.
Figure 12:
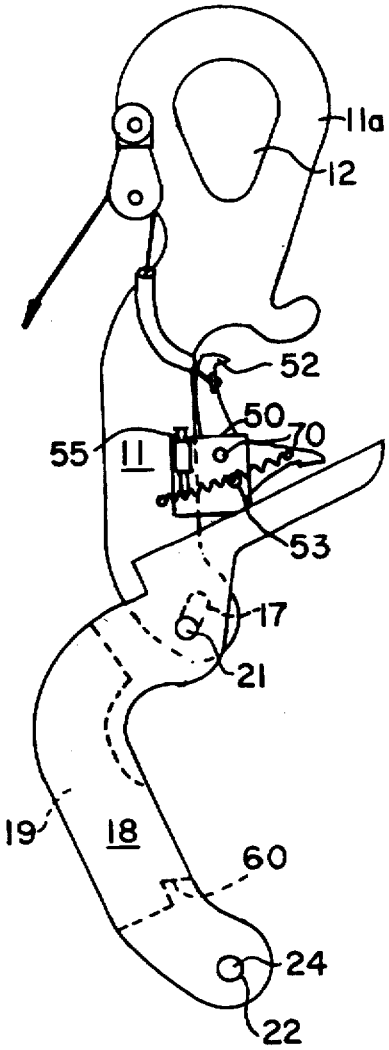
FIG. 12 is a side view of the cable disconnector device of FIG. 9 illustrating the pivotal movement of the jaw member from the closed to the open position in accordance with one embodiment of the present invention.
Figure 11:
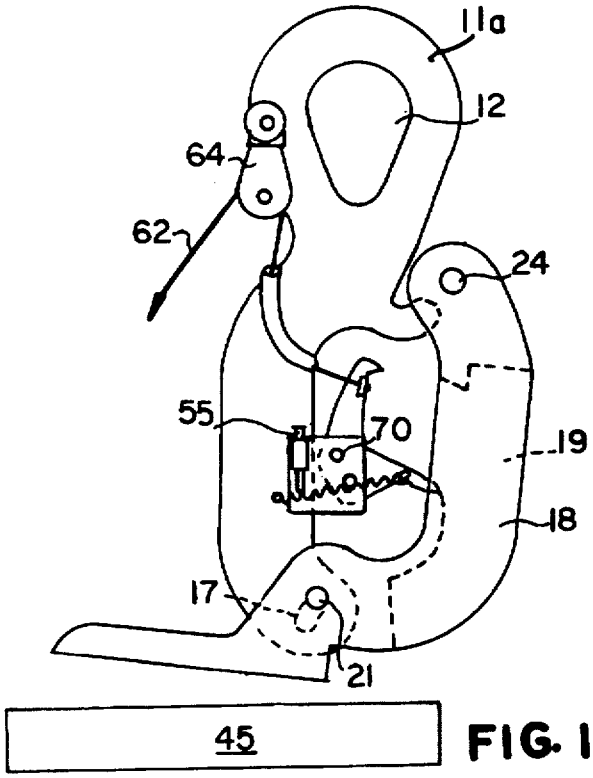
FIG. 11 is a side view of the cable disconnector device of FIG. 9 with the locking mechanism being released and the pivotally hinged jaw member moving to the unlocked position.
Figure 13:
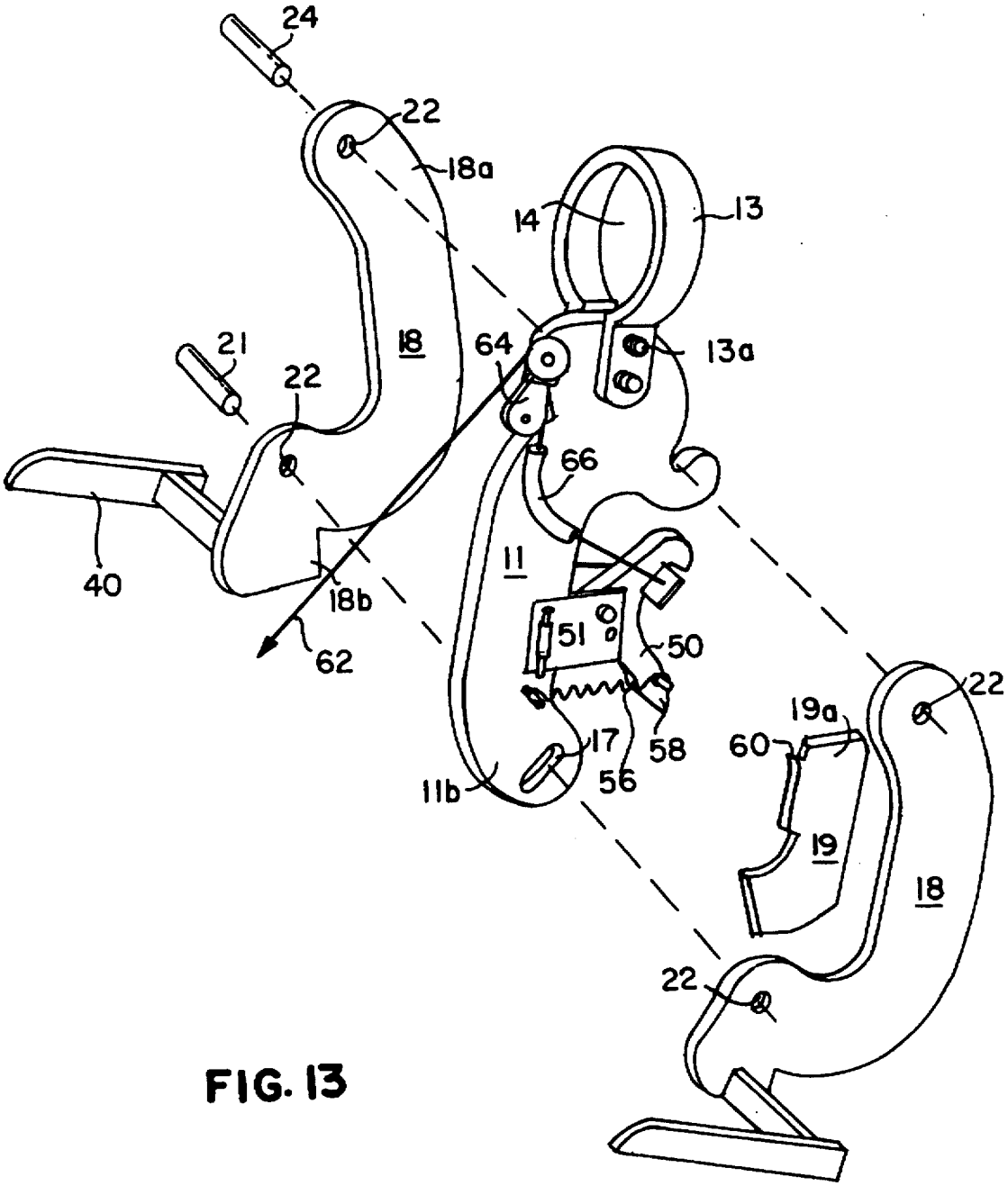
FIG. 13 is a perspective view of structural elements illustrating the assembly of the cable disconnector device in accordance with a further object of the present invention.

As shown in FIGS. 9 and 12, the present invention includes openings 53 in the bracket member 51 which are aligned with an opening, as shown in dotted line 53, in the L-shaped locking member, which openings are axially aligned when the locking member is in its unlocked position. Into the aligned openings a pin member 55 may be inserted therethrough to manually retain or lock the locking member 50 in the unlocked position, as shown in FIG. 12 when utilization of the locking member 50 is not desired.

Figure 14:
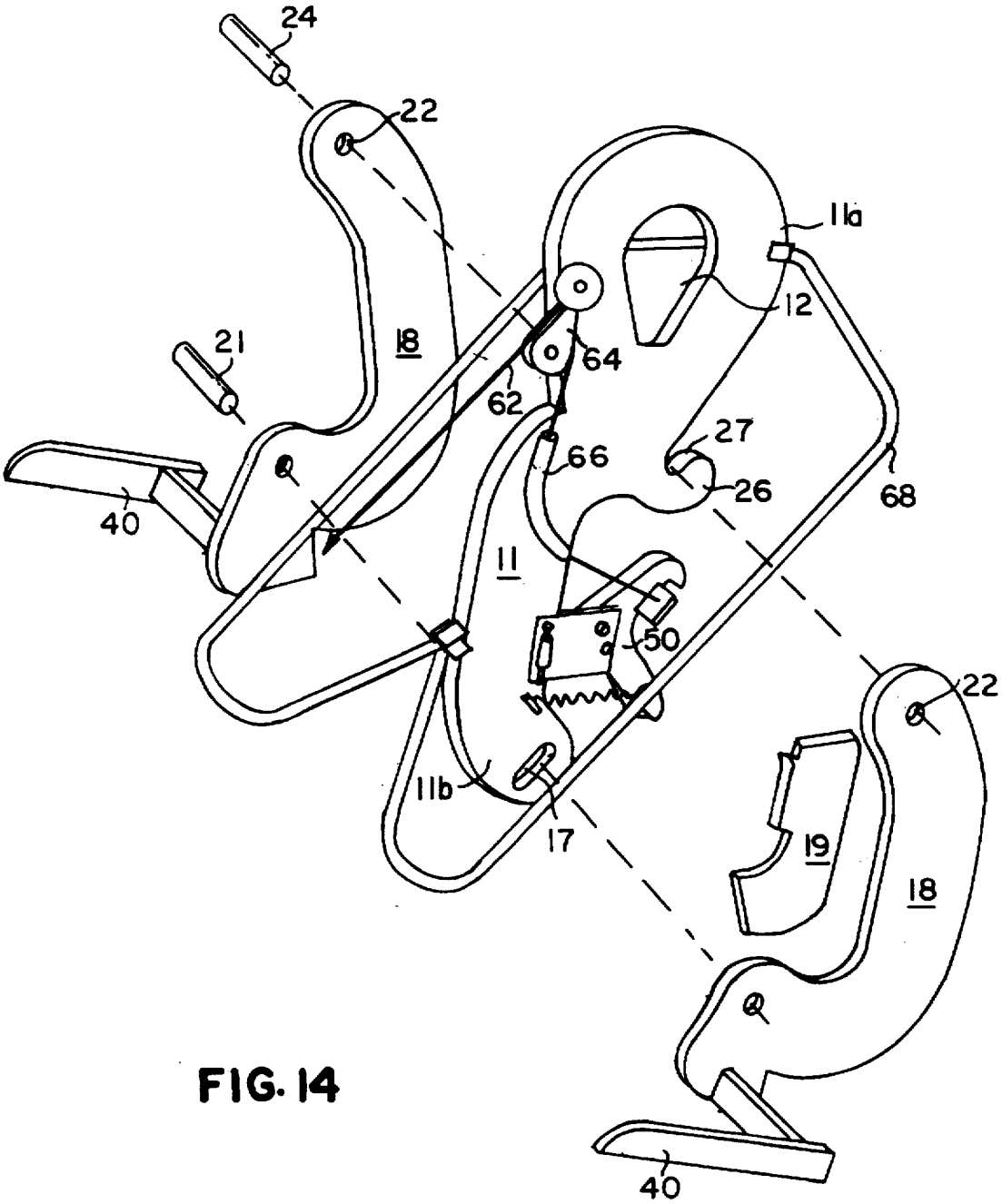
FIG. 14 is perspective view of a further embodiment of the cable disconnector device in accordance with the present invention.

Finally, as shown in FIG. 14, a shield member or means 68 may be mounted to the vertical suspended base portion 11 of the disconnector assembly 10. The shield member prevents the lifting cable or cables 38 or the cable member 62 from engaging the feet extensions and inadvertently disconnecting the assembly 10 from the lifted material during operation of the disconnector assembly.

Figure 7:
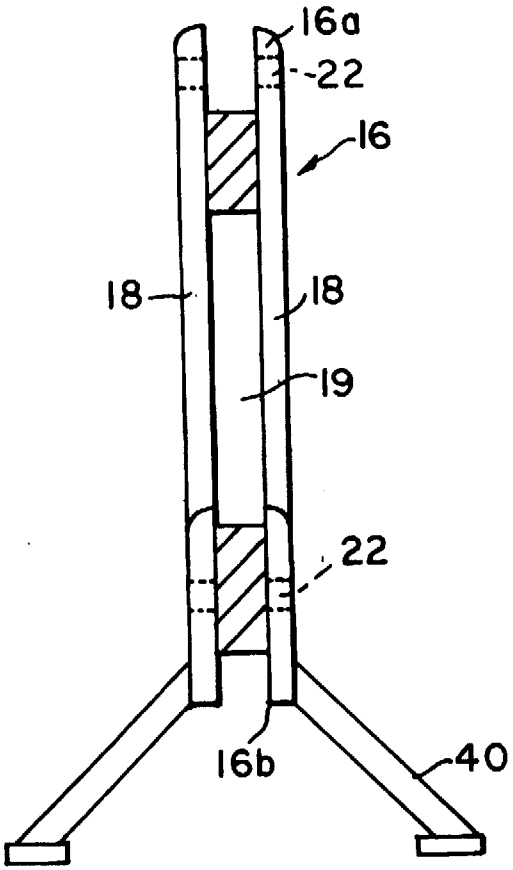
FIG. 7 is a frontal view of the jaw member in accordance with a further embodiment of the present invention.
Figure 6:
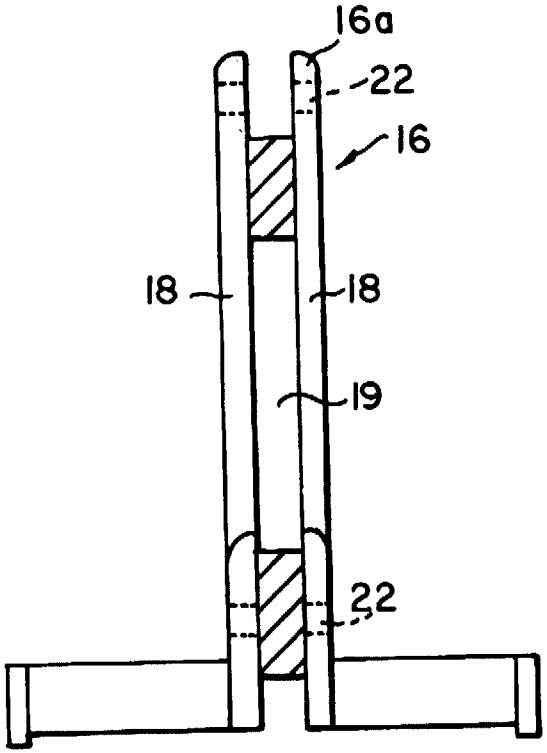
FIG. 6 is frontal view of the jaw portion of the cable disconnector device in accordance with the present invention.

While particular embodiments of the present invention have been shown and described, it will be obvious to those skilled in the art that changes and modifications may be made without departing from the invention in its broader aspects. For example, as shown in FIGS. 6 and 7, the facing plates 18 include winged extensions 40 extending outwardly therefrom which facilitate the engagement of the cable disconnector device to the upper surface to the truss material. As shown in FIG. 6, these wings extensions or means 40 extend outwardly perpendicularly from the lower end 16B of the facing plates 18 and, in FIG. 7, the wing extensions 40 extend outwardly and downwardly at an angle with respect to each of the facing plates 18. However, it is only sufficient for the purposes of the present invention that the lower end portion 16*b* of the hinged jaw member 16 include some type of projection or means extending therefrom which is sufficient to engage the top surface 45 of the resting and positioned bar, joist, or truss material to facilitate the release of the disconnector device in accordance with the present invention.

I claim:

1. A cable disconnector assembly for use with a lifting hook of a lifting assembly for lifting material and for disconnecting a lifting cable from the lifted material when the lifted material is in a resting position, including in combination:

a vertical suspended member portion having an upper end eyelet portion engageable with the lifting hook of the lifting assembly and a lower end portion opposite said upper end eyelet portion, said lower end portion having a slotted opening therein and said vertical suspended member portion having a recessed shoulder thereon;

a jaw member having a lower end portion hingedly mounted to said lower end portion of said vertical suspended member portion through said slotted opening, said jaw member being operable between an open disengaging position and a closed engaging position wherein said jaw member is engageable with said recessed shoulder of said vertical suspended member portion with said lower end portion of said jaw member including an engaging portion, which is structurally arranged to permit engagement with the resting lifted material to permit said jaw member to move from said closed engaging position to said open disengaging position to permit said jaw member to disconnect the lifting cable from the lifted material; and wherein said jaw member is comprised of a pair of facing plates in mirror image to one another with a spacer member therebetween to define a yoke-type upper end portion having aligned openings therein which are adapted to fixedly receive and mount a pin member therebetween, with said mounted pin member being engageable with said recessed shoulder of said vertical member portion to provide the closed engaging position during lifting of the lifted material.

2. The cable disconnector assembly in accordance with claim 1, wherein said facing plates and said spacer member of said jaw member define a yoke-type lower end portion which is hingedly mounted to said lower end portion of said vertical suspended member portion.

3. The cable disconnector assembly in accordance with claim 2, wherein said yoke-type lower end portion includes aligned openings therein which are adapted to receive a pin member, with said pin member extending through said slotted opening to hingedly mount said jaw member to said lower end portion of said vertical suspended member portion.

4. The cable disconnector assembly in accordance with claim 1, wherein said slotted opening permits said jaw member to be hingedly mounted to said lower end portion of said vertical suspended member portion and to be movable between a lower closed engaging position and an upper open disengaging position when said lower end portion of said jaw member engages the resting lifted material.

5. A cable disconnector assembly for use with a lifting hook of a lifting assembly for lifting material and for disconnecting a lifting cable from the lifted material when the lifted material is in the resting position, including in combination:

a vertical suspended member portion having an upper end eyelet portion engageable with the lifting hook of the lifting assembly and a lower end portion opposite said upper end eyelet portion, said lower end portion having a slotted opening therein and an extension member extending therefrom, with said vertical suspended member portion having a recessed shoulder thereon;

a jaw member hingedly mounted by a pin member to said lower end portion of said vertical suspended member portion through said slotted opening in said lower end portion, said jaw member being structurally arranged to pivot about said pin member and being operable between an open disengaging position and a closed engaging position wherein said jaw member is engageable with said recessed shoulder of said vertical suspended member portion;

wherein a lower end portion of said jaw member is structurally arranged to provide engagement with the resting lifted material and to permit said jaw member to move from said closed engaging position to said open disengaging position to permit disconnection of the lifting cable from the lifted material; and wherein said jaw member is comprised of a pair of facing plates in mirror image to one another with a spacer member therebetween, with each of said facing plates having axially aligned openings therein which receive and secure a pin member therebetween and engage said recessed shoulder on said vertical suspended portion during lifting of the material.

6. The cable disconnector assembly in accordance with claim 5, wherein said facing plates and said spacer member of said jaw member define a yoke-type lower end portion which is hingedly mounted to said lower end portion of said vertical suspended member portion.

7. The cable disconnector assembly in accordance with claim 5, wherein said slotted opening permits said jaw member to be movable between a lower closed engaging position and an upper open disengaging position when said lower end portion of said jaw member engages the resting lifted material.

8. The cable disconnector assembly in accordance with claim 5, wherein said jaw member defines a yoke-type upper end portion having aligned openings therein which are adapted to fixedly receive and mount a pin member therebetween, with said mounted pin member being engageable with said recessed shoulder of said vertical suspended member portion to provide the closed engaging position during lifting of the lifted material.

* * * * *